US007762312B2

(12) United States Patent
Beyer-Steinhauer et al.

(10) Patent No.: US 7,762,312 B2
(45) Date of Patent: Jul. 27, 2010

(54) METHOD AND DEVICE FOR DRIVING SUPPORT ROLLERS ON A CONTINUOUS CASTING MACHINE FOR MOLTEN METALS IN PARTICULAR FOR MOLTEN STEEL MATERIALS

(75) Inventors: Holger Beyer-Steinhauer, Mettmann (DE); Axel Weyer, Wuppertal (DE); Karl Hoen, Asbach (DE)

(73) Assignee: SMS Siemag Aktiengesellschaft, Düsseldorf (DE)

( * ) Notice: Subject to any disclaimer, the term of this patent is extended or adjusted under 35 U.S.C. 154(b) by 633 days.

(21) Appl. No.: 10/591,518

(22) PCT Filed: Jan. 27, 2005

(86) PCT No.: PCT/EP2005/000802

§ 371 (c)(1),
(2), (4) Date: Jul. 23, 2007

(87) PCT Pub. No.: WO2005/084841

PCT Pub. Date: Sep. 15, 2005

(65) Prior Publication Data

US 2008/0035300 A1 Feb. 14, 2008

(30) Foreign Application Priority Data

Mar. 2, 2004 (DE) ..... 10 2004 010 038

(51) Int. Cl.
*B22D 11/128* (2006.01)

(52) U.S. Cl. ..... 164/484; 164/441; 164/447

(58) Field of Classification Search ..... 164/484, 164/441, 447

See application file for complete search history.

(56) References Cited

FOREIGN PATENT DOCUMENTS

| | | |
|---|---|---|
| EP | 0 350 431 | 10/1990 |
| EP | 0 625 388 | 11/1994 |
| JP | 2003-33854 A * | 2/2003 |

OTHER PUBLICATIONS

Patent Abstracts of Japan, vol. 2003, No. 06, Jun. 3, 2003 & JP 2003 033854 A (Nippon Steel Corp), Feb. 4, 2003.

Patent Abstracts of Japan, vol. 1999, No. 11, Sep. 30, 1999 & JP 11 151558 A (Yaskawa Electric Corp), Jun. 8, 1999.

Patent Abstracts of Japan, vol. 1995, No. 08, Sep. 29, 1995 & JP 07 136751 A (Kobe Steel Ltd), May 30, 1995.

(Continued)

*Primary Examiner*—Kevin P Kerns
(74) *Attorney, Agent, or Firm*—Friedrich Kueffner

(57) ABSTRACT

A method and device for driving the support rolls of a continuous casting machine for liquid metals, which support rolls form a strand guide for the continuously cast strand. The strand guide includes electrically driven individual support rolls and/or hydraulically adjustable support roll segments. An automatic load balance control system for the drives is used as the sum of the individual forces for casting speed, motor torque, motor speed, and standard correction factors and is provided with individual adjustment of torque and speed of each drive support roll motor. A total driving torque for all drives is determined from the normal force of the driven drive support rolls and proportionately transmitted to each support roll in such a way that a static base setting of the torque distribution is used as the basis for the specific load capacity of each drive support roll.

14 Claims, 3 Drawing Sheets

OTHER PUBLICATIONS

Patent Abstracts of Japan, vol. 004, No. 187, Dec. 12, 1980 & JP 55 133855 A (Hitachi Ltd), Oct. 18, 1980.
Patent Abstracts of Japan, vol. 010, No. 088, Apr. 5, 1986 & JP 60 227958 A (Yasukawa Denki Seisakusho KK), Nov. 13, 1985.
Patent Abstracts of Japan, vol. 006, No. 001, Jan. 7, 1982 & JP 56 126061 A (Yasakawa Electric MFG Co Ltd), Oct. 2, 1981.
Patent Abstracts of Japan, vol. 009, No. 100, May 2, 1985 & JP 59 225866 A (Shin Nippon Seitetsu KK), Dec. 18, 1984.

* cited by examiner (State of the Art)

METHOD AND DEVICE FOR DRIVING SUPPORT ROLLERS ON A CONTINUOUS CASTING MACHINE FOR MOLTEN METALS IN PARTICULAR FOR MOLTEN STEEL MATERIALS

BACKGROUND OF THE INVENTION

The invention concerns a method and a device for driving the support rolls of a continuous casting machine for liquid metals, especially liquid steel materials, which support rolls form a strand guide for the continuously cast strand, which strand guide consists of electrically driven individual support rolls and/or hydraulically adjustable support roll segments, wherein an automatic load balance control system for the drives is used as the sum of the functions of casting speed, motor torque, motor speed, and standard correction factors.

The strand guide for the continuously cast strand, which is cast in billet, slab, thin-slab, preliminary-section or ingot format, simultaneously serves as a withdrawal device which withdraws the continuously cast strand emerging from the continuous casting mold through the strand guide against the resistance it offers. The strand guide comprises idle (not driven) support rolls and driven drive support rolls positioned opposite a support roll. The drive support rolls transmit both guide forces and strand conveyance forces in cooperation with the dragged support rolls and are pressed against the continuously cast strand with a well-defined contact force. All of the drive support rolls together overcome the forces of resistance to withdrawal to which the strand is subjected on its way through the strand guide.

The power of these drives is generally adjusted in such a way that, on the one hand, reliable withdrawal of the continuously cast strand is guaranteed in every conceivable operating situation, but, on the other hand, the production costs and operating costs are kept as low as possible, and the drives are not needlessly overdimensioned.

Two different methods are known for transmitting the driving torques of the individual drives to the continuously cast strand.

In the first method, the drives are manually adjusted and then left to themselves during the operation.

In a second method (see FIG. 1 on the state of the art), the sum of the driving torques ($M_1$-$M_n$) of all active drives is determined, and the mean value is taken. This mean value is fed back to each drive as the set driving torque. By means of an automatic load balance control system, an attempt is made to adjust the delivered driving torque to the set value by making speed changes ($n_{set-n}$) in the given drive.

Both control methods have the disadvantage that the driving torques are not assigned according to the forces or torques that can actually be transmitted. The result of this is that drives are able to apply only a smaller torque than the set torque and thus permanently rotate at a greatly increased speed due to their low normal force, whether as the result of roll wear or technological limitations, and this means that the drive rolls are subject to increased wear.

Another disadvantage is that in the case of drives that could transmit more than the mean torque when a process-related short-term increase in the resistance to withdrawal arises and a higher total torque is required, only the mean value of the total torque is called up, i.e., these drives are asked to deliver less torque than they could, while other drives are unable to transmit the required set torque for the reasons specified above. This process can lead to stoppage of the continuously cast strand, which results in a discontinuation of casting with large losses.

EP 0 463 203 B discloses a guide method for the electric drives of rolls of a continuous casting plant, wherein the continuously cast strand is drawn from the continuous casting mold by the driven rolls, whose drives are individually automatically controlled by automatic controllers, and wherein the set point assignment for the roll drives is made as a function of load, for example, via the speed assignment. This is intended to achieve load balance among the individual roll drives. However, this method does not take into consideration either situations that are not operationally related or a total expenditure of power, which allows control of the total driving force that is to be applied in normal cases according to experience.

SUMMARY OF THE INVENTION

The objective of the invention is to distribute to the drives the total driving torque that is to be applied in normal cases according to their natural transmission capacity on the basis of the normal force of each support roll and drive support roll.

In accordance with the invention, this objective is achieved by determining a total driving torque for all drives from the normal force of the driven support rolls and proportionately transmitting it to each support roll, and by using a static base setting of the torque distribution as the basis for the specific load capacity of each drive support roll. On the one hand, this prevents unnecessary racing of the drive support rolls. On the other hand, it guarantees that the maximum possible driving torque can actually be transmitted to the cast strand by the drive rolls. In addition, roll wear is significantly reduced. The method can be used not only in conventional strand support roll segments with a separately adjustable drive support roll but also in support roll segments with the drive roll integrated in the top frame, in a pure drive by means of driving rolls, and in mixed forms of drive variants.

In accordance with the invention, this objective is achieved by determining a total driving torque for all drives from the normal force of the driven support rolls and proportionately transmitting it to each support roll, and by using a static base setting of the torque distribution as the basis for the specific load capacity of each drive support roll. On the one hand, this prevents unnecessary racing of the drive support rolls. On the other hand, it guarantees that the maximum possible driving torque can actually be transmitted to the cast strand by the drive rolls. In addition, roll wear is significantly reduced. The method can be used not only in conventional strand support roll segments with a separately adjustable drive support roll but also in support roll segments with the drive roll integrated in the top frame (CyberLink segments), in a pure drive by means of driving rolls, and in mixed forms of drive variants.

In a refinement of the invention, the specific load capacity of a drive support roll is determined from the geometry of the strand guide, the ferrostatic head and/or the distance between the rolls.

In accordance with other features of the invention, the set values are corrected by feedback to the automatic load balance control system of the current contact forces of the piston-cylinder units of a strand support roll segment or a drive support roll and functional values of the casting format.

In a further refinement of the invention, these correction values can be used to obtain a dynamic factor derived from the contact forces of the individual torques and from the individual speeds for the preassigned torque value for each drive from the ratio of the current normal force of the drive support roll to the theoretical normal force.

Furthermore, an additional correction factor for the roll wear and the friction conditions between the cast strand and the support rolls or drive support rolls can be taken into account. An additional criterion of the previously existing deviations can be determined in this way.

According to other features of the invention, the accuracy of the automatic control method can be enhanced by considering an unweighted overall factor formed from the specific load capacity, the dynamic factor, and the additional correction factor.

Another refinement takes into consideration a weighted overall factor formed from the unweighted overall factor by multiplication with the ratio of the number of all active drives to the sum of all unweighted factors of all active drives.

In accordance with other features, a closed-loop control system is provided for each drive and is supplied with the mean value of the driving torques of all active drives and of the set-point speed.

Building on this, the mean value, together with the weighted overall factor in each case, is supplied to the automatic controllers as a set point, and each automatic controller converts it to a speed set point.

Another special feature is that, for the determination of the mean value or the summation of the driving torques, only those drives are considered which are suitable for the transmission of the driving torque.

In cases in which the process situation allows a measure of this type, it is provided that the current contact forces of the piston-cylinder units for the strand support roll segments or of the drive support rolls or of the piston-cylinder units of the drive support rolls are increased until the required driving torque is transmitted.

A prior-art device for driving drive support rolls of a continuous casting machine for liquid metals, especially liquid steel materials, comprises a strand guide for the continuously cast strand, which strand guide consists of electrically driven individual drive support rolls and/or hydraulically adjustable strand support roll segments, wherein an automatic load balance control system for the drives is developed as the sum of the individual forces for casting speed, motor torque, motor speed, and standard correction factors.

In accordance with the invention, the device for achieving the objective of the invention is characterized by the fact that the automatic load balance control system has a computer block for determining the torque distribution, whose input variables consist at least of the number "n" of active drives and the load capacity of the individual drive support rolls, wherein processing values expressed by the plant-specific design of the strand guide and the geometric data of the continuously cast strand are input, and that information about the state of wear of the drive support rolls and the current contact forces F and the current driving torques M are used as input variables.

In a refinement of the basic idea of the invention, a set point M is determined in the computer block from the input variables and introduced into each torque controller as an input variable.

In accordance with additional features, each torque controller is connected to a speed controller, to which a correction speed for the electric motor is transmitted.

A specific embodiment of the invention is illustrated in the drawings and explained in greater detail below.

DETAILED DESCRIPTION OF THE INVENTION

Figure 1:
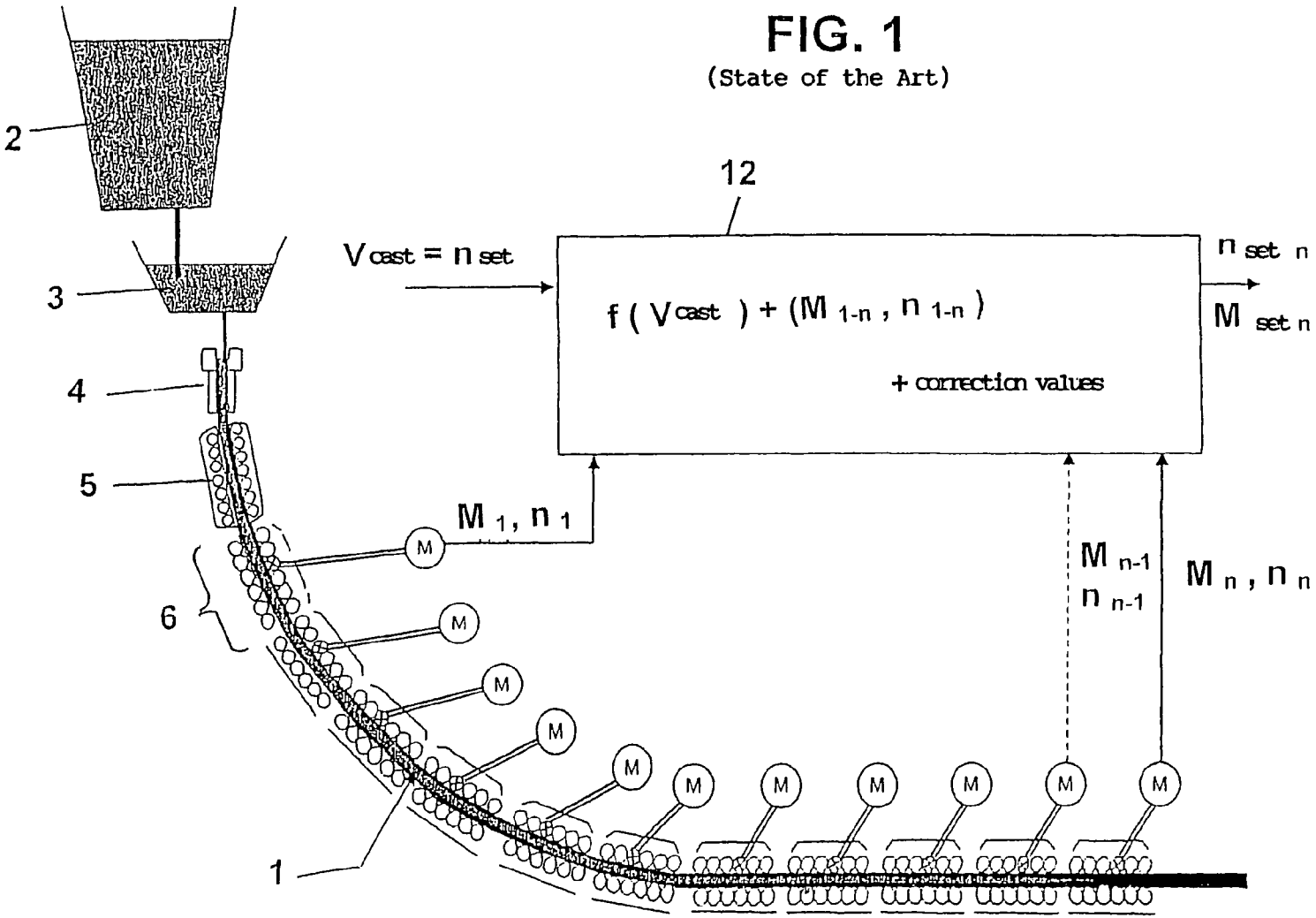
FIG. 1 shows a general side view of a continuous casting plant with an automatic load balance control system in accordance with the present state of the art.

The continuously cast strand (FIGS. 1 and 2) is formed in the continuous casting process, in which the liquid metal, especially liquid steel material, is conveyed from the ladle 2 through a tundish 3, a strand shell forms in the continuous casting mold 4 by cooling, and the strand is conveyed further, cooled further, and withdrawn.

In contrast to the prior art (FIG. 1), in accordance with the invention (FIG. 2), a strand guide 7 for the continuously cast strand 1 is formed by a segment (without adjustment and without driving of the support rolls), followed by segments 6 with idly rotating support rolls 7*a* with suitable roll separation 7*b* and independently adjusted drive support rolls 7*c*. The drive support rolls 7*c* are equipped with a drive 10, which for rotating support rolls, consists of an electric motor 8, and for a strand support roll segment 9 (consisting of a set of idle support rolls 7*a*), there is an individual electric motor 8 for each drive support roll 7*c*. A hydraulic piston-cylinder unit 11 for adjusting individual support rolls 7*a* and drive support rolls 7*s* is also designated as a drive 10.

In an automatic load balance control system 12 (FIG. 1), the sum of the driving torques $M_1$-$M_n$ of all active drives 10 is computed, and the mean value is taken. This mean value is fed back to each drive 10 as the set-point driving torque $M_{set\,n}$. An attempt is made by means of one controller each (in the automatic load balance control system 12) to adjust the delivered driving torque of the respective drive to the set point by speed changes $n_{set\,n}$ of the respective drive 10. The correcting values are the speed set point and the torque set point.

Figure 2:
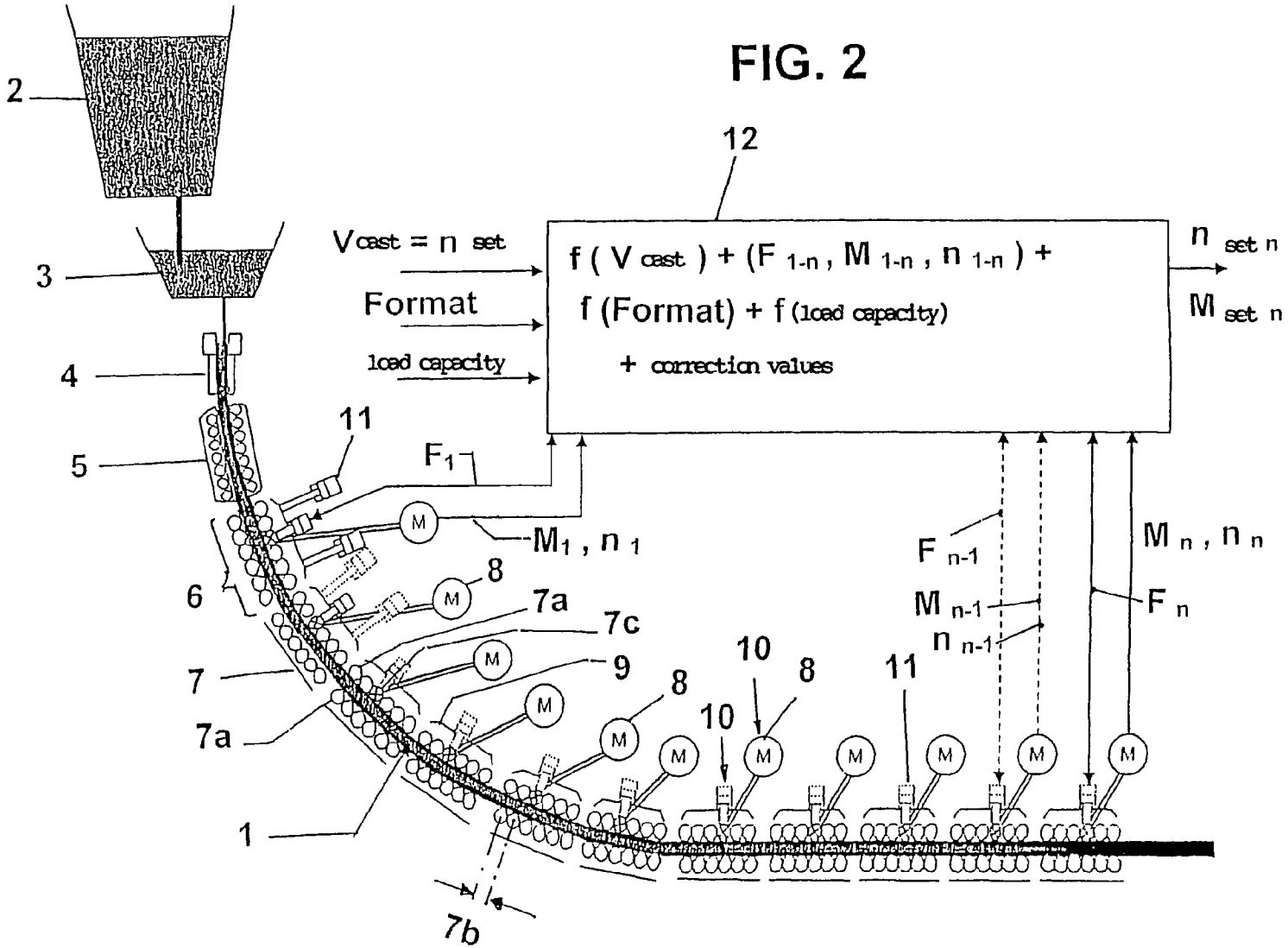
FIG. 2 shows the same general side view of the continuous casting plant with an automatic load balance control system in accordance with the invention.

In contrast to the prior art (FIG. 1), FIG. 2 shows a method for driving drive support rolls 7*c* of the illustrated continuous casting machine as an example of a continuous slab-casting installation for liquid metals, especially liquid steel materials, in which the strand guide 7 for the continuously cast strand 1 is formed by electrically driven, individual drive support rolls 7*c* and by the hydraulically adjustable strand support roll segments 9, wherein the automatic load balance control system 12 for the drives is assumed as the sum of the individual forces for casting speed, motor torque, motor speed, and standard correction factors.

The total driving torque for all drives 10 is determined from the normal force of the driven drive support rolls 7*c* and transmitted proportionately to each drive support roll 7*c* according to the local conditions, such that a static base setting of the torque distribution is used as the basis for the specific load capacity of each drive support roll 7*c*. The specific load capacity of a driven support roll 7*c* is determined from the geometry of the strand guide 7 (e.g., a bow-type continuous casting installation), the ferrostatic head (height difference of the liquid strand core to the liquid metal level of the continuous casting mold 4) and/or the roll separation. The current contact forces $F_1$-$F_n$ of the piston-cylinder units 11 of a strand support roll segment 9 or of a drive support roll 7*c* and functional values of the casting format are fed back to the automatic load balance control system 12. A dynamic factor derived from the contact forces $F_1$-$F_n$ of the individual torques and from the individual speeds $n_{1-n}$ for the preassigned torque value for each drive 10 is obtained from the ratio of the current normal force of the drive support rolls 7*c* to the theoretical normal force.

An additional correction factor for the roll wear and the friction conditions between the cast strand 1 and the support rolls 7*a* or drive support rolls 7*c* can also be taken into account. In addition, an unweighted overall factor formed from the specific load capacity, the dynamic factor, and the additional correction factor can be considered. In this regard, a weighted overall factor is formed from the unweighted overall factor by multiplication with the ratio of the number of all active drives 10 to the sum of all unweighted factors of all active drives 10 and then taken into consideration.

A closed-loop control system is provided for each drive 10 (drive support rolls 7*c* and/or hydraulic piston-cylinder unit 11) and is supplied with the mean value of the driving torques of all active drives 10 and of the set-point speed $n_{set}$. The mean value, together with the weighted overall factor in each case, is supplied to the automatic controllers as set point $M_{set}$, and each automatic controller converts it to a speed set point $n_{set}$. In this regard, for the determination of the mean value or the summation of the driving torques, only those drives 10 are considered which are suitable for the transmission of the driving torque, i.e., capable of transmission.

In addition, the current contact forces $F_1$-$F_n$ of the piston-cylinder units 11 for the strand support roll segments 9 or of the drive support rolls 7*c* or of the piston-cylinder units 11 of the drive support rolls 7*c* can be increased until the required driving torque is transmitted.

Figure 3:
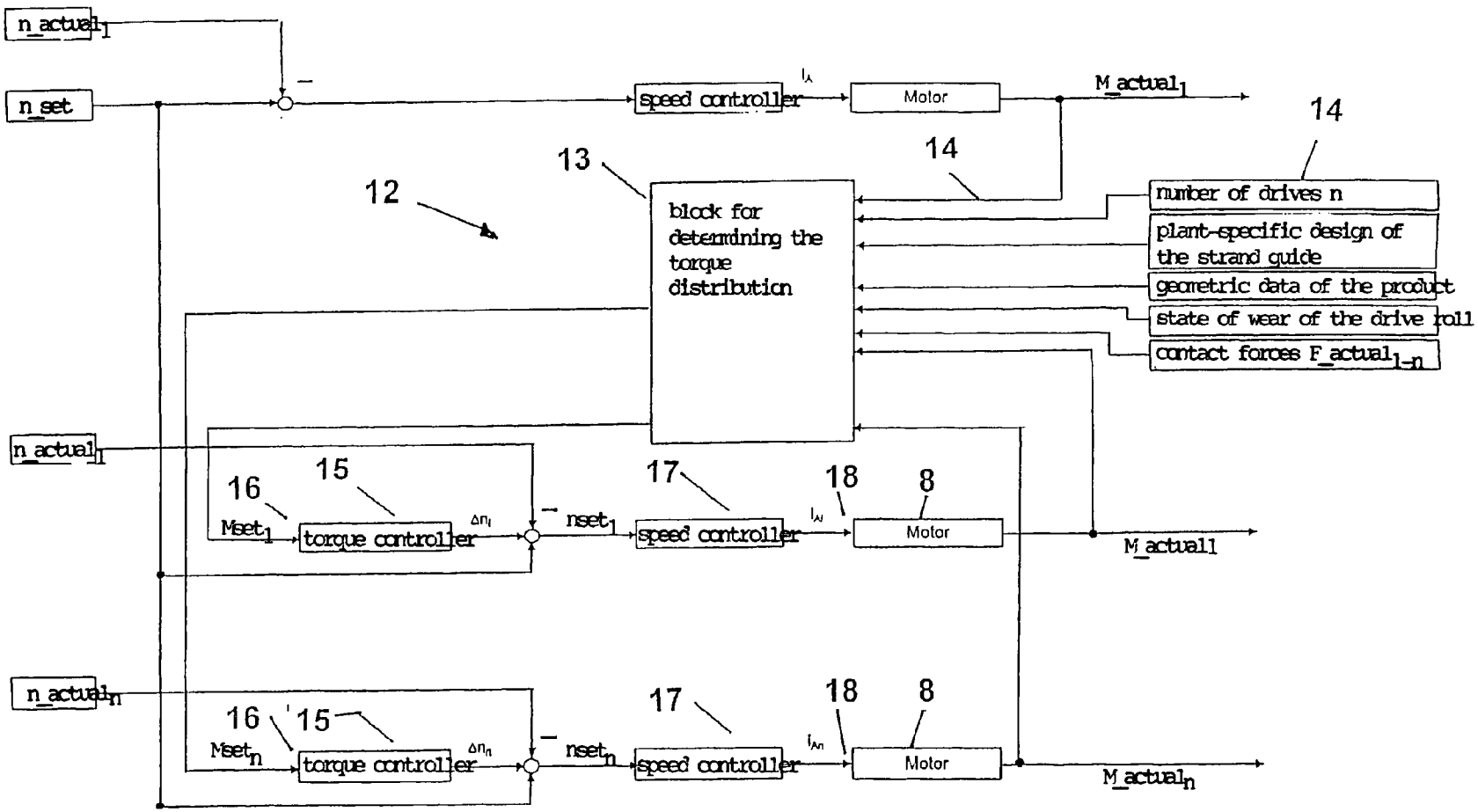
FIG. 3 shows a functional block diagram of the automatic load balance control system.

The automatic load balance control system 12 (FIG. 3) has a computer block 13 for determining the torque distribution, whose input variables 14 consist of the number of active drives "n", values for the plant-specific design of the strand guide 7, geometric data of the continuously cast strand 1, state of wear of the drive support rolls 7*c*, and the contact forces F with the actual value. The load capacity of the individual drive support rolls 7*c* is also taken into account in making this determination. Processing values are provided for the plant-specific design of the strand guide 7 and the geometric data of the continuously cast strand 1. Information about the state of wear of the drive support rolls 7*c* and the current contact forces F and the current driving torques M are used as additional input variables 14. A set point M is determined in the computer block 13 from the input variables and introduced into each torque controller as an input variable 16. In addition, each torque controller 15 is connected to a speed controller 17, to which a correction speed 18 for the electric motor 8 is transmitted.

LIST OF REFERENCE NUMBERS

1 continuously cast strand
2 ladle
3 tundish
4 continuous casting mold
5 segment without adjustment and without driving of the support rolls
6 segment with independently adjusted drive support roll
7 strand guide
7*a* support rolls, idle
7*b* roll separation
7*c* drive support rolls
8 electric motor
9 strand support roll segment
10 drive
11 hydraulic piston-cylinder unit
12 automatic load balance control system
13 computer block
14 input variable
15 torque controller
16 input variable
17 speed controller
18 correction speed

The invention claimed is:

1. Method for driving support rolls (7*c*) of a continuous casting machine for liquid metals, which support rolls form a strand guide (7) for a continuously cast strand (1), which strand guide comprises electrically driven individual support rolls (7*c*) and/or hydraulically adjustable support roll segments (9), comprising the steps of: using an automatic load balance control system (12) for all drives (10) as a sum of individual forces for casting speed, motor torque, motor speed, and standard correction factors; providing the control system with individual adjustment of torque and speed of each drive support roll motor; determining a total driving torque for all drives (10) from a normal force of the driven drive support rolls (7*c*); and proportionately transmitting the total driving torque to each support roll (7*c*) in such a way that a static base setting of torque distribution is used as a basis for the specific load capacity of each drive support roll (7*c*).

2. Method in accordance with claim 1, wherein the specific load capacity of a drive support roll (7*c*) is determined from geometry of the strand guide (7), ferrostatic head, and/or roll separation (7*b*).

3. Method in accordance with claim 1, wherein current contact forces ($F_1$-$F_n$) of piston-cylinder units (11) of a strand support roll segment (9) or of a drive support roll (7*c*) and operational values of a casting format are fed back to the automatic load balance control system (12).

4. Method in accordance with claim 3, wherein a dynamic factor derived from the contact forces ($F_1$-$F_n$) of individual torques ($M_{1-n}$) and from individual speeds ($n_{1-n}$) for a preassigned torque value for each drive (10) is obtained from a ratio of a current normal force of the drive support roll (7*c*) to a theoretical normal force.

5. Method in accordance with claim 1, wherein an additional correction factor for roll wear and friction conditions between the cast strand (1) and the support rolls (7*a*) or drive support roll (7*c*) is taken into account.

6. Method in accordance with claim 1, wherein an unweighted overall factor formed from the specific load capacity, a dynamic factor, and an additional correction factor is taken into consideration.

7. Method in accordance with claim 6, wherein a weighted overall factor is formed from the unweighted overall factor by multiplication with a ratio of the number of all active drives (10) to a sum of all unweighted factors of all active drives (10) and taken into consideration.

8. Method in accordance with claim 7, wherein a closed-loop control system is provided for each drive (10) and is supplied with mean value of driving torques of all active drives (10) and of a set-point speed ($n_{set}$).

9. Method in accordance with claim 8, wherein the mean value, together with the weighted overall factor in each case, is supplied to automatic controllers as a set point ($M_{set}$), and each automatic controller converts it to a speed set point ($n_{set}$).

10. Method in accordance with claim 8, wherein for determining the mean value or a summation of the driving torques, only those drives (10) are considered which are suitable for transmission of the driving torque.

11. Method in accordance with claim 8, wherein current contact forces ($F_1$-$F_n$) of piston-cylinder units (11) for the strand support roll segments (9) or of the drive support rolls (7*c*) or of piston-cylinder units (11) of the drive support rolls (7*c*) are increased until a required driving torque is transmitted.

12. Device for driving drive support rolls (7*c*) of a continuous casting machine for liquid metals, comprising a strand guide (7) for a the continuously cast strand (1), which strand guide (7) comprises electrically driven individual drive support rolls (7*c*) and/or hydraulically adjustable strand support roll segments (9), wherein an automatic load balance control system (12) for all drives (10) is developed as a sum of individual forces for casting speed, motor torque, motor speed, and standard correction factors and is provided with individual adjustment of the torque and speed of each drive support roll motor (8), wherein the automatic load balance control system (12) has a computing unit (13) for determining a torque distribution, whose input variables (14) include at least a number "n" of active drives (8, 11) and a load capacity of the individual drive support rolls (7*c*), wherein processing values expressed by plant-specific design of the strand guide (7) and geometric data of the continuously cast strand (1) are input, and information about a state of wear of the drive support rolls (7*c*) and current contact forces $F_{1\text{-}n}$ and current driving torques $M_{actual,\ 1\text{-}n}$ are used as input variables (14).

13. Device in accordance with claim 12, wherein a set point $M_{set,\ 1\text{-}n}$ is determined in the computing unit (13) from the input variables (14) and introduced into each torque controller (15) as an input variable (16).

14. Device in accordance with claim 13, wherein each torque controller (15) is connected to a speed controller (17), to which a correction speed (18) for an electric motor (8) can be transmitted.

* * * * *